US010358610B2

(12) United States Patent
Malek Abbaslou et al.

(10) Patent No.: US 10,358,610 B2
(45) Date of Patent: Jul. 23, 2019

(54) PROCESS FOR PARTIAL UPGRADING OF HEAVY OIL

(71) Applicant: Sherritt International Corporation, Fort Saskatchewan (CA)

(72) Inventors: Mohammad Reza Malek Abbaslou, Fort Saskatchewan (CA); Ali Abbaspour Gharamalek, Edmonton (CA); Iftikhar Huq, Fort Saskatchewan (CA); John Henry Marsh, St. Albert (CA)

(73) Assignee: Sherritt International Corporation, Fort Saskatchewan (CA)

( * ) Notice: Subject to any disclaimer, the term of this patent is extended or adjusted under 35 U.S.C. 154(b) by 107 days.

(21) Appl. No.: 15/496,921

(22) Filed: Apr. 25, 2017

(65) Prior Publication Data

US 2017/0306252 A1 Oct. 26, 2017

Related U.S. Application Data

(60) Provisional application No. 62/327,187, filed on Apr. 25, 2016.

(51) Int. Cl.
*C10G 65/10* (2006.01)
*C10G 47/26* (2006.01)
(Continued)

(52) U.S. Cl.
CPC ..... *C10G 65/10* (2013.01); *C10G 45/00* (2013.01); *C10G 45/58* (2013.01); *C10G 47/00* (2013.01);
(Continued)

(58) Field of Classification Search
CPC ..... C10G 47/02; C10G 47/06; C10G 47/26; C10G 49/02; C10G 49/12; C10G 65/10
See application file for complete search history.

(56) References Cited

U.S. PATENT DOCUMENTS 3,888,761 A 6/1975 Stewart
4,485,004 A 11/1984 Fisher et al.
(Continued)

FOREIGN PATENT DOCUMENTS

CA 2809503 C 6/2013

OTHER PUBLICATIONS

Speight, James G. and Baki Ozum, Petroleum Refining Processes, Chapter 17, pp. 516-517 (Year: 2001).*
(Continued)

*Primary Examiner* — Renee Robinson
(74) *Attorney, Agent, or Firm* — Leydig, Voit & Mayer, Ltd.

(57) ABSTRACT

A process is provided to partially upgrade heavy oil using two or more reaction zones connected in series, each reaction zone being a continuous stirred tank maintained at hydrocracking conditions. The heavy oil feedstock and a solid particulate catalyst are stirred to form pumpable slurry which is heated to a target hydrocracking temperature and then continuously fed to the first reaction zone. Hydrogen is continuously introduced to the reaction zone to achieve hydrocracking and to produce a volatile vapor stream carried upwardly by the hydrogen to produce an overhead vapor stream. The hydrocracked heavy oil slurry from one reaction zone is fed to a next reaction zone also maintained under hydrocracking conditions with a continuous hydrogen feed to produce a volatile vapor stream. The overhead vapor stream from each reactor zone is continuously removed, and the hydrocracked heavy oil slurry from the last of the reaction zones is removed.

25 Claims, 3 Drawing Sheets

(51) Int. Cl.

| | |
|---|---|
| ***C10G 49/12*** | (2006.01) |
| ***C10G 45/58*** | (2006.01) |
| ***C10G 47/00*** | (2006.01) |
| ***C10G 45/00*** | (2006.01) |
| ***C10G 47/04*** | (2006.01) |
| ***C10G 47/06*** | (2006.01) |
| ***C10G 65/00*** | (2006.01) |

(52) U.S. Cl.

CPC ..... *C10G 47/04* (2013.01); *C10G 47/06* (2013.01); *C10G 47/26* (2013.01); *C10G 49/12* (2013.01); *C10G 65/00* (2013.01)

(56) References Cited

U.S. PATENT DOCUMENTS

| | | | | |
|---|---|---|---|---|
| 4,606,809 | A | 8/1986 | Garg | |
| 5,110,447 | A | 5/1992 | MacWilliams et al. | |
| 6,096,192 | A | 8/2000 | Myers et al. | |
| 6,139,723 | A * | 10/2000 | Pelrine | B01J 23/745 201/2.5 |
| 6,319,395 | B1 | 11/2001 | Kirkbride et al. | |
| 6,355,159 | B1 | 3/2002 | Myers et al. | |
| 6,402,939 | B1 | 6/2002 | Yen et al. | |
| 6,660,158 | B1 | 12/2003 | Ellingsen | |
| 6,955,753 | B1 | 10/2005 | Gomez | |
| 6,989,091 | B2 | 1/2006 | Jorgensen | |
| 7,001,502 | B1 | 2/2006 | Satchwell et al. | |
| 7,223,713 | B2 | 5/2007 | Alonso et al. | |
| 7,449,103 | B2 | 11/2008 | Lott et al. | |
| 7,578,928 | B2 | 8/2009 | Lott et al. | |
| 7,585,406 | B2 | 9/2009 | Khadzhiev et al. | |
| 7,597,794 | B2 | 10/2009 | Zhao et al. | |
| 7,625,466 | B2 | 12/2009 | Yeung | |
| 7,651,604 | B2 | 1/2010 | Ancheyta Juárez et al. | |
| 7,691,256 | B2 | 4/2010 | Montanari et al. | |
| 7,892,416 | B2 | 2/2011 | Ellingsen | |
| 7,943,035 | B2 | 5/2011 | Chornet et al. | |
| 7,967,954 | B2 | 6/2011 | Jorgensen | |
| 7,976,695 | B2 | 7/2011 | Brecher | |
| 8,017,000 | B2 | 9/2011 | Montanari et al. | |
| 8,022,259 | B2 | 9/2011 | Bauer et al. | |
| 8,057,660 | B2 | 11/2011 | Marchionna et al. | |
| 8,105,480 | B2 | 1/2012 | Chornet et al. | |
| 8,105,482 | B1 | 1/2012 | Freel et al. | |
| 8,110,090 | B2 | 2/2012 | Zimmerman et al. | |
| 8,147,675 | B2 | 4/2012 | Marchionna et al. | |
| 8,236,169 | B2 | 8/2012 | Nguyen et al. | |
| 8,349,268 | B2 | 1/2013 | Yeung | |
| 8,435,400 | B2 | 5/2013 | Kou et al. | |
| 8,617,386 | B2 | 12/2013 | Bhattacharyya et al. | |
| 8,834,708 | B2 | 9/2014 | Milam et al. | |
| 8,888,992 | B2 | 11/2014 | Hedrick et al. | |
| 9,011,674 | B2 | 4/2015 | Milam et al. | |
| 9,045,699 | B2 | 6/2015 | Brecher et al. | |
| 2003/0014911 | A1 | 1/2003 | Gunnerman | |
| 2006/0054534 | A1 | 3/2006 | Chen et al. | |
| 2006/0054535 | A1 | 3/2006 | Chen et al. | |
| 2008/0156693 | A1 * | 7/2008 | Okui | C10G 7/06 208/58 |
| 2010/0200463 | A1 | 8/2010 | Patron et al. | |
| 2011/0215030 | A1 | 9/2011 | Corscadden | |
| 2012/0211402 | A1 | 8/2012 | Monaghan et al. | |
| 2012/0305384 | A1 | 12/2012 | Zaikin et al. | |
| 2013/0277275 | A1 | 10/2013 | Hill et al. | |
| 2014/0102944 | A1 * | 4/2014 | Bauer | C10G 47/02 208/112 |
| 2014/0209509 | A1 | 7/2014 | Hassan et al. | |
| 2014/0221709 | A1 * | 8/2014 | Baldassari | C10G 47/26 585/251 |
| 2014/0238897 | A1 | 8/2014 | Kou et al. | |
| 2015/0329790 | A1 | 11/2015 | Yang et al. | |
| 2015/0344790 | A1 | 12/2015 | Ferrughelli et al. | |
| 2016/0010004 | A1 | 1/2016 | Oehr | |
| 2016/0060549 | A1 | 3/2016 | Ancheyta Juarez et al. | |
| 2016/0362615 | A1 | 12/2016 | Ancheyta Juarez et al. | |

OTHER PUBLICATIONS

Baldassari et al. (2012) "LC-MAX and Other LC-FINING Process Enhancements to Extend Conversion on On-Stream Factor," In; The American Fuel & Petrochemical Manufacturers Annual Meeting, Mar. 11-13, 2012. San Diego, California.

Bellussi et al. (Dec. 2013) "Hydroconversion of heavy residues in slurry reactors: Developments and perspectives," Journal of Catalysis. 308:189-200.

Castañeda et al. (2012) "Combined Process schemes for upgrading of heavy petroleum," Fuel. 100:110-127.

Colyar et al. (1998) "H-Oil Process Based Heavy Crudes Refining Schemes," In; The Proc. 7th Unitar Conference on Heavy Crude and Tar Sands. Beijing, China, Oct. 27-30, 1998. p. 857.

De Falco et al. (Copyright 2015) "Current Situation of Emerging Technologies for Upgrading Heavy Oils," Oil & Gas Portal. Accessible on the Internet at URL: http://www.oil-gasportal.com/current-situation-of-emerging-technologies-for-upgrading-heavy-oils/?print=pdf, 13 pgs.

Kressmann et al. (1998) "Recent developments in fixed-bed catalytic residue upgrading," Catalysis Today. 43:203-215.

Kressmann et al. (2000) "Improvements of Ebullated-Bed Technology for Upgrading Heavy Oils," Oil & Gas Science and Technology—Rev. IFP. 55(4):397-406.

Kunnas et al. (2011) "Improving residue hydrocracking performance," Digital Refining. Q3. pp. 1-9.

Marzin et al. (1988) "HDH, A process for residue conversion," In; The Fourth UNITAR/UNDP International Conference on Heavy Crude and Tar Sands. Edmonton, Alberta. Paper 202.

Morel et al. (1997) "Processes and Catalysts for Hydrocracking of Heavy Oil and Residues," Stud. Surf. Sci. Catal. 106:1-16.

Niemann et al. (1993) "The VEBA-COMBI-CRACKING-Technology: An update," Fuel Processing Technology. 35:1-20.

Panariti et al. (2000) "Petroleum residue upgrading with dispersed catalysts Part 1, Catalysts activity and selectivity," Applied Catalysis A: General. 204:203-213.

International Search Report with Written Opinion corresponding to International Patent Application No. PCT/CA2017/000098, dated Aug. 30, 2017.

International Preliminary Report on Patentability, dated Nov. 8, 2018, corresponding to International Application No. PCT/CA2017/000098 (filed Apr. 25, 2017), a related application, 5 pp.

Sue et al. (1989) "Mild Resid Hydrocracking for Heavy Oil Upgrading," Fourth UNITAR/UNDP International Conference on Heavy Crude and Tar Sands, Paper No. 86.

* cited by examiner

PROCESS FOR PARTIAL UPGRADING OF HEAVY OIL

CROSS-REFERENCE TO RELATED APPLICATION

This application claims priority from U.S. Provisional Patent Application No. 62/327,187 filed Apr. 25, 2016, which is incorporated by reference herein to the extent that there is no inconsistency with the present disclosure.

FIELD OF THE INVENTION

The present invention generally relates to a process of slurry hydrocracking for partial upgrading of heavy oil, for instance for storage, transport and/or further upgrading.

BACKGROUND OF THE INVENTION

Heavy oil, extra-heavy oil and bitumen (herein collectively "heavy oil") cannot be transported by pipeline in a raw state due to a very high viscosity and density. Currently there are two options to make a heavy oil feedstock transportable, for instance by pipeline to refineries. In one option, a diluent is added to heavy oil to reduce the viscosity and the density of the blend to a value meeting the requirements for pipeline transport. Typically about one volume of diluent is required for between two and three volumes of heavy oil, so significant pipeline capacity is taken up by the diluent. The diluent must then be separated at the receiving refinery. In a second option, the heavy oil feedstock is upgraded to synthetic crude oil (SCO), which can then be processed directly in refineries. Upgrading occurs when the carbon number of the heavy oil is shifted from an average of 25 to 30 for each molecule to about 7 to 15 in the upgraded product. At the same time, the hydrogen-to-carbon ratio is increased from between about 1.3 and 1.5 in the heavy oil to between about 1.6 and 2.2 in the upgraded product.

In practice, heavy oil can be upgraded to improve the hydrogen-to-carbon ratio according to two routes. The first involves the rejection of carbon and the second involves the addition of hydrogen. FIG. 1 shows exemplary schemes associated with these prior art upgrading efforts, which are briefly described below.

Processes which are based on coking and de-asphalting of heavy oil (i.e., carbon rejection) suffer from product loss and low yield. In coking processes, carbon losses to coke and asphaltenes may account for over 20% (m/m) of the feed which amounts to a considerable loss of product, considering that the product still requires further refining. Solvent requirements in de-asphalting processes and the high amount of energy required to separate the solvent from de-asphalted oil also add considerable costs. Examples of carbon rejection processes include the CCU Process by UOP, the JetShear process by Fractal Systems Inc., and the WRITE process by Western Research Institute. Some carbon rejection processes overcome the poor conversion efficiencies by gasifying the coke co-product to produce a synthesis gas that can be used for process heat or can be converted into liquid hydrocarbons by, for example, Fischer Tropsch synthesis. The FT-Crude process is an example of this process. This approach results in a complex process flowsheet and high capital costs.

Hydrogen addition processes are based on hydrocracking in the presence of a suitable catalyst. The purpose of the catalyst is to activate the addition of hydrogen and kinetically suppress the formation of gases and coke. The majority of hydrogen addition processes utilize catalysts formulated from metals in the columns 6, 8, 9 and 10 of the Periodic Table. These catalysts are tailored for selective conversion and high activity in order to maximize process throughput and product quality. Challenges associated with selective and high activity catalysts are rapid deactivation, high costs, and complex catalyst preparation, handling and recovery procedures. The reactors used are designed primarily to manage the handling of the catalysts in an effective way. In so doing, the reactors suffer from excessive capital costs, a narrow range of operating conditions and high maintenance. As a consequence of the need for effective catalyst management, hydrocracking processes are defined by the type of reactor used. There are two main reactor types used for hydrocracking, namely fixed bed reactors and fluidized bed reactors.

Fixed-bed reactors have been used to hydrocrack residues containing low concentrations of metals. In many cases, the operation of fixed bed reactors is severely inhibited by the rapid deactivation of the catalyst which results in high operating pressure, low conversion, uneven temperature distribution, and poor quality products. The low catalyst cycle time makes fixed bed processes capital intensive with limited overall benefits.

There are several types of fluidized bed reactors that can be used. Examples are ebullated bed reactors and bubble column reactors. Ebullated bed reactors are suited to the three-phase mixing of gases, liquids and solids, where mixing results from the upward flow of gas and liquid, that also results in the formation of an expanded catalyst bed. The catalysts are generally particles with sizes that fall into the millimeter domain. Ebullated bed reactors allow the handling of higher amounts of metals and fine solids in the feed as the catalyst is easily replaced. However when using supported metal catalysts, these reactors suffer from poor conversion of asphaltenes and the formation of sediments or sludge. This is due primarily to limited mass transfer in the catalyst pores. Other disadvantages associated with these reactors include firstly, the narrow range of gas flow rates required to maintain the catalyst particles in a fluidized condition; and secondly, a limited liquid residence time due to the high gas holdup required for fluidization.

An improvement on supported metal catalyst in fluidized bed reactors is the use of dispersed catalysts, which are colloidal suspensions of nano-sized catalytic particles. This improvement typically takes the form of a slurry comprised of oil and finely dispersed catalyst (typically a transition metal sulphide such as Mo or W) which is fed into a hydrocracking reactor. The high density of available reaction sites avoids the plugging of pores that causes deactivation of supported metal catalysts. However, maintaining uniform dispersion of the catalyst particles remains a challenge, and has typically been limited to hydrogen induced mixing in bubble column reactors.

Slurry hydroconversion processes using bubble column and ebullated bed reactors have been applied to the upgrading of heavy oil and bitumen with the objective of producing a bottomless SCO that is characterized by an API gravity of at least 30°, removal of sulphur and heteroatoms, and a reduction in viscosity. Examples of upgrading processes that utilize packed bed, ebullated bed or bubble column reactors are the Eni Slurry Technology (EST) by Eni S.p.A., the HCAT Process by Headwaters Technology Innovation, the Uniflex Process by UOP, Veba Combi-Cracking (VCC) by BP and KBR and the HDH Process by PDVSA.

In contrast to producing a SCO by upgrading, partial upgrading of heavy oil and bitumen seeks to produce an oil product with an API gravity above about 19° (for example, between 20° and 30°), a viscosity less than about 350 cSt (at 7.5° C.), and a partial reduction in the concentration of sulphur and other heteroatoms. This partially upgraded crude product may then be transported, for example by pipeline, to a refinery for further processing.

The use of bubble column or ebullated bed reactors in a partial upgrading process presents a challenge due to the low margins associated with the partially upgraded products, the high capital intensity and high operating costs. Examples of recent patents that teach a method of partial upgrading of heavy oil and bitumen through slurry hydroconversion are shown below.

In U.S. Pat. Nos. 6,096,192 and 6,355,159, a two-step method is used to produce a pipeline-ready oil. The heavy hydrocarbon is treated by a slurry hydroconversion process in the presence of phosphomolybdic acid at a concentration of between 150 and 500 ppm or coke-derived fly ash catalyst (between 0.5 and 5% (m/m)), under a pressure and temperature in the range of 48 to 103 bar and 400 to 450° C. The oil produced in this manner still does not meet pipeline specifications and therefore requires further mixing with sufficient diluent to meet the pipeline specifications.

In U.S. Pat. No. 4,485,004, a process for upgrading heavy oil and bitumen is taught in which a slurry of the heavy hydrocarbon, a hydrogen donor solvent (such as tetralin), and a particulate hydroconversion catalyst (such as Co, Mo, Ni, W or spent hydrodesulphurization catalyst) is treated under hydrogen. Typical operating conditions include a pressure and temperature in the range of 110 to 170 bar and 400 to 450° C., a catalyst concentration in the range of 3 and 5% (m/m) and a residence time between 2 and 3.5 h.

SUMMARY

Broadly stated, a process is provided for partial upgrading of a heavy oil feedstock of one or more of heavy oil, extra heavy oil and bitumen. The process includes:

stirring the heavy oil feedstock and a solid particulate catalyst, with optional heating to reduce the initial viscosity of the feedstock, to form a pumpable slurry;

heating the slurry to a target temperature for hydrocracking;

continuously feeding the heated slurry to a first reaction zone comprising a first continuous stirred tank maintained at hydrocracking conditions while continuously introducing hydrogen to the first reaction zone to achieve hydrocracking of the heavy oil in the slurry and to produce a volatile vapour stream including condensable and non-condensable hydrocarbons and other gases, and carrying the volatile vapour stream upwardly with the hydrogen in the first reaction zone to produce an overhead vapour stream;

continuously feeding the hydrocracked heavy oil slurry from the first reaction zone to a second reaction zone comprising a second continuous stirred tank maintained at same or different hydrocracking conditions as in the first reaction zone, while continuously introducing hydrogen to the second reaction zone to achieve further hydrocracking of the heavy oil in the slurry and to produce a volatile vapour stream including condensable and non-condensable hydrocarbons and other gases, and carrying the volatile vapour stream upwardly with the hydrogen in the second reaction zone to produce an overhead vapour stream;

optionally continuously feeding the further hydrocracked heavy oil slurry from the second reaction zone to one or more further reaction zones connected in series, each further reaction zone comprising a further continuous stirred tank maintained at same or different hydrocracking conditions as in the first and second reaction zones, while continuously introducing hydrogen to each of the one or more further reaction zones to achieve further hydrocracking of the heavy oil in the slurry and to produce in each further reaction zone a further volatile vapour stream including condensable and non-condensable hydrocarbons and other gases, and carrying the volatile vapour stream upwardly with the hydrogen in each of the one or more further reaction zone to produce a further overhead vapour stream for each of the one or more further reaction zones;

continuously removing the overhead vapour stream from the first, second and any of the one or more further reaction zones; and removing the further hydrocracked heavy oil slurry from the second reaction zone or from the last of the one or more further reaction zones to provide a partially upgraded heavy oil slurry.

As used herein and in the claims, the terms and phrases set out below have the following definitions.

"API Gravity" refers to API Gravity at 15° C., for example as determined by ASTM Method D6822, where ASTM refers to American Society for Testing and Materials.

"Bar" or "bars" is a unit of pressure, where 1 bar is equivalent to 0.1 MPa.

"bbl" refers to a barrel of oil, which is equivalent to 0.159 $m^3$.

"Catalyst" refers to a catalyst, or to a catalyst precursor which is in situ activated, for example by sulphur in a feed, and which is catalytically active for hydrocracking.

"Coke" refers to a solid carbonaceous material formed primarily of a hydrocarbon material and that is insoluble in toluene as determined by ASTM Method D4072.

"Continuous Stirred Tank" or "CST" refers to a continuously fed and continuously stirred tank reactor or a continuously fed and continuously stirred compartment in a reactor.

"Conversion" refers to the percentage of residue in the feed that is converted to lighter fractions with a boiling point less than 540° C.

"Distillate" refers to the fraction of heavy oil or partially upgraded heavy oil with a boiling point less than 340° C.

"Fully upgraded heavy oil" refers to a bottomless SCO characterized by an API gravity of at least 30° and a reduced viscosity with removal of sulphur and heteroatoms compared to heavy oil.

"Heavy oil" as feed or feedstock to the process of this invention, refers to heavy oil, extra-heavy oil, bitumen, and mixtures of same. Heavy oil feedstock can be liquid, semi-solid, and/or solid. Examples that can be upgraded by the process described herein include, without limitation, Canadian oil sands bitumen and heavy oil such as Athabasca bitumen, Mexican Maya Crude, Venezuelan heavy oil, Cuban heavy oil, such as from Varadero, Cuba, and atmospheric and vacuum residues from refineries. In general, "extra-heavy oil" has an API gravity less than 8°, "bitumen" has an API gravity less than 10°, and "heavy oil" has an API gravity less than 19°. Herein, the term "heavy oil" as feed or feedstock to the process includes one or more of extra-heavy oil, bitumen and heavy oil.

"Hydrocracking" refers to a catalytic process to reduce the boiling range of a heavy oil feedstock by converting a portion of the feedstock to products with boiling ranges lower than that of the original feedstock, including by fragmentation of larger hydrocarbon molecules into smaller molecular fragments having a lower number of carbon atoms and a higher hydrogen to carbon atomic ratio.

"Hydrogen" refers to molecular hydrogen unless atomic hydrogen is specified, such as in hydrogen-to-carbon atomic ratios, but otherwise, the term "hydrogen" includes gases containing a majority of molecular hydrogen.

"Mild hydrocracking conditions" refers to hydrocracking conditions to produce a partially upgraded heavy oil, which are less severe than conditions for a fully upgraded heavy oil.

"Non-condensable gas" refers to components or a mixture of components that are gases at 25° C. and 0.101 MPa.

"Partially upgraded heavy oil" refers to a product stream from the hydrocracking process which is upgraded by the hydrocracking process for improved transport properties, including an increase in the API gravity and a decrease in the viscosity compared to heavy oil. For a partially upgraded heavy oil product to be transportable by pipeline, current pipeline specifications include an API gravity of at least 19° and a maximum viscosity of 350 cSt. If the partially upgraded heavy oil product does not achieve a sufficient degree of upgrading during hydrocracking, it can be combined with minor amounts of lighter fractions such as a hydrocarbon diluent to be transportable by pipeline.

"Residue" refers to the fraction of heavy oil or partially upgraded heavy oil with a boiling point greater than 540° C.

"scf" refers to a standard cubic foot, where 1 scf (at 0.101 MPa and 15.5° C.) is equivalent to 0.0283 $m^3$.

"Stirring" or "stirred" refers to intimate high shear mechanical mixing of two or more components of a mixture or slurry with one or more impellers or agitators to obtain a generally uniform distribution and suspension of the components.

"Slurry" refers to a liquid medium such as heavy oil, in which solid particles, such as catalyst, are generally uniformly suspended therein, generally by stirring.

"VGO" or Vacuum Gas Oil, refers to hydrocarbons with a boiling range distribution from 343 to 540° C. at 0.101 MPa. VGO may be determined in accordance with ASTM Method D5307.

"Yield" refers to the ratio of the volume of liquid products to the volume of heavy oil feed multiplied by 100 and stated as a percentage (%).

DETAILED DESCRIPTION OF THE INVENTION

Figure 1:
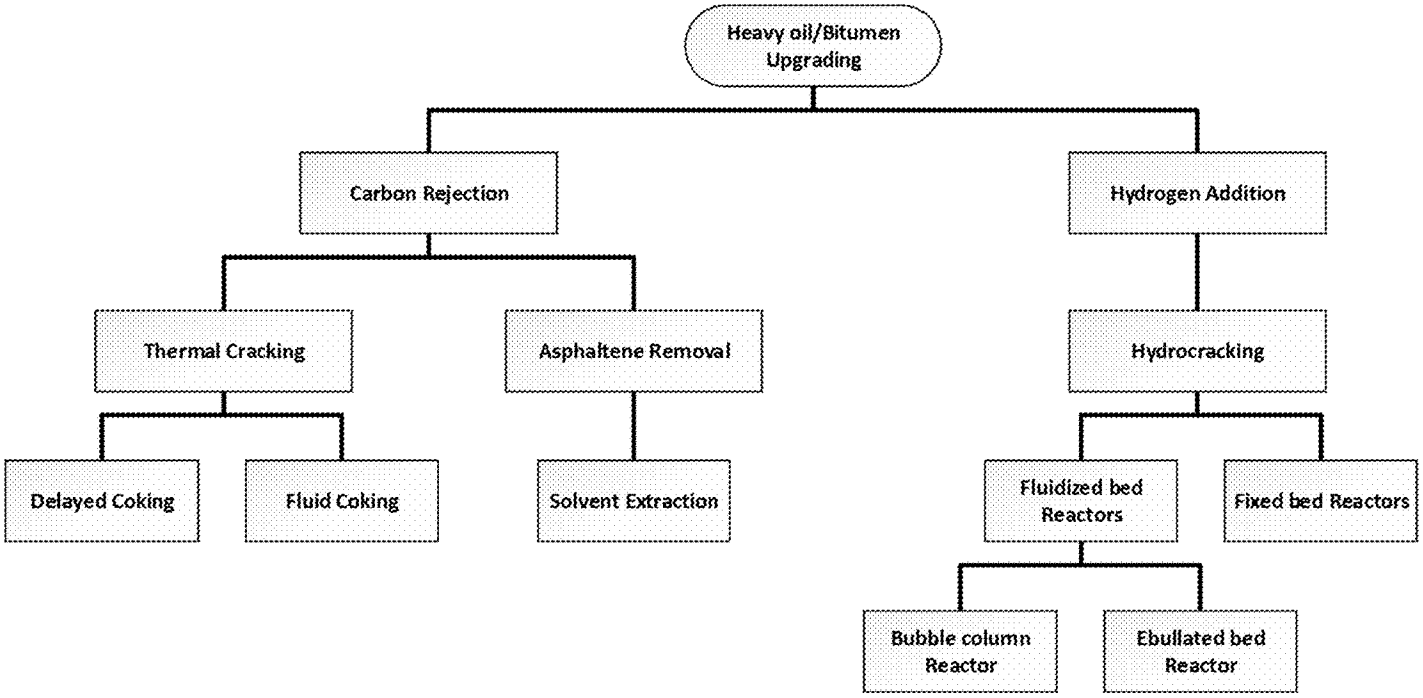
Prior Art Figure 1
FIG. 1 is a schematic showing known process routes for the upgrading of heavy oil.
Figure 2:
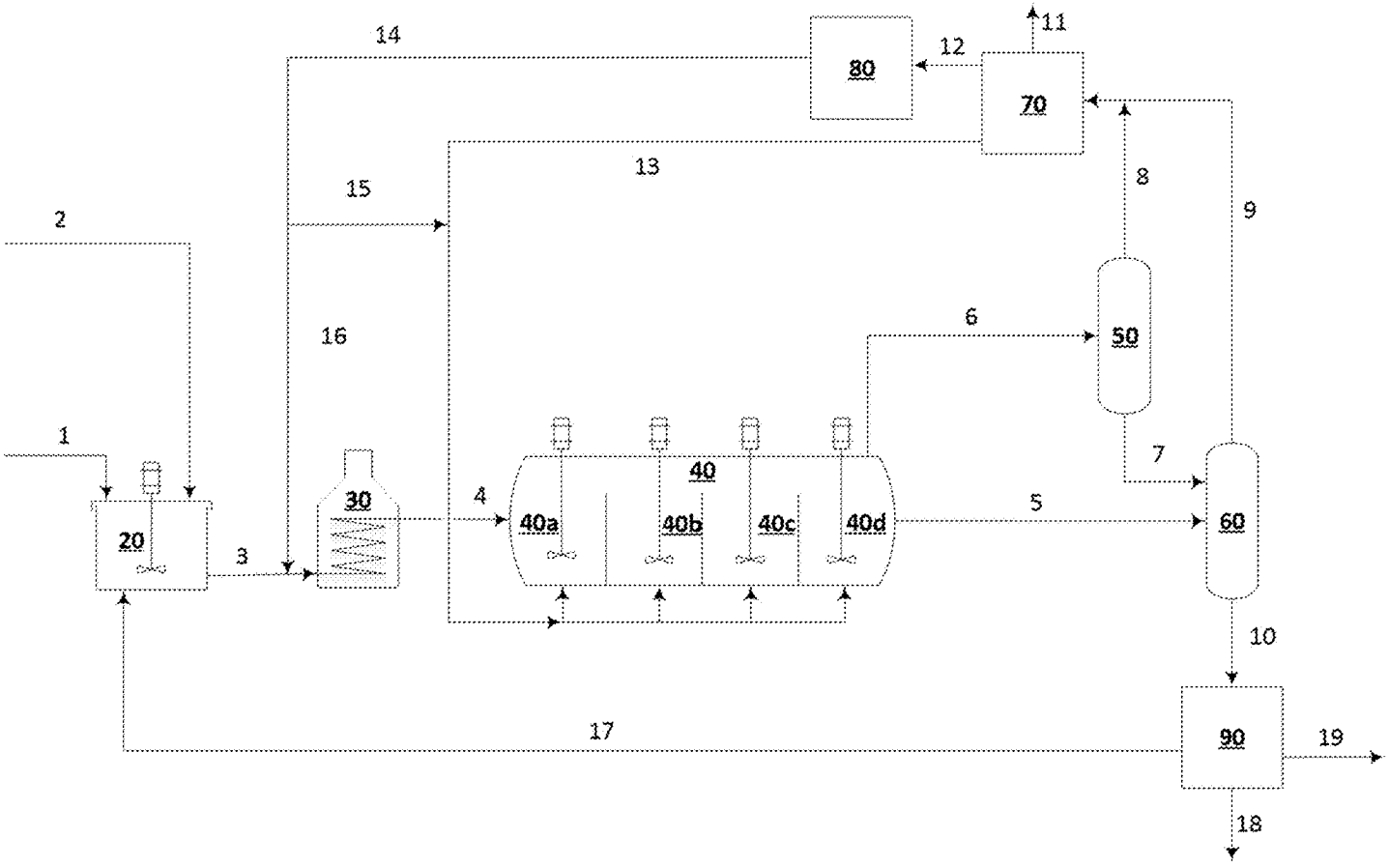
FIG. 2 is a flow diagram showing the partial upgrading process for heavy oil according to one embodiment of the invention.
Figure 3:
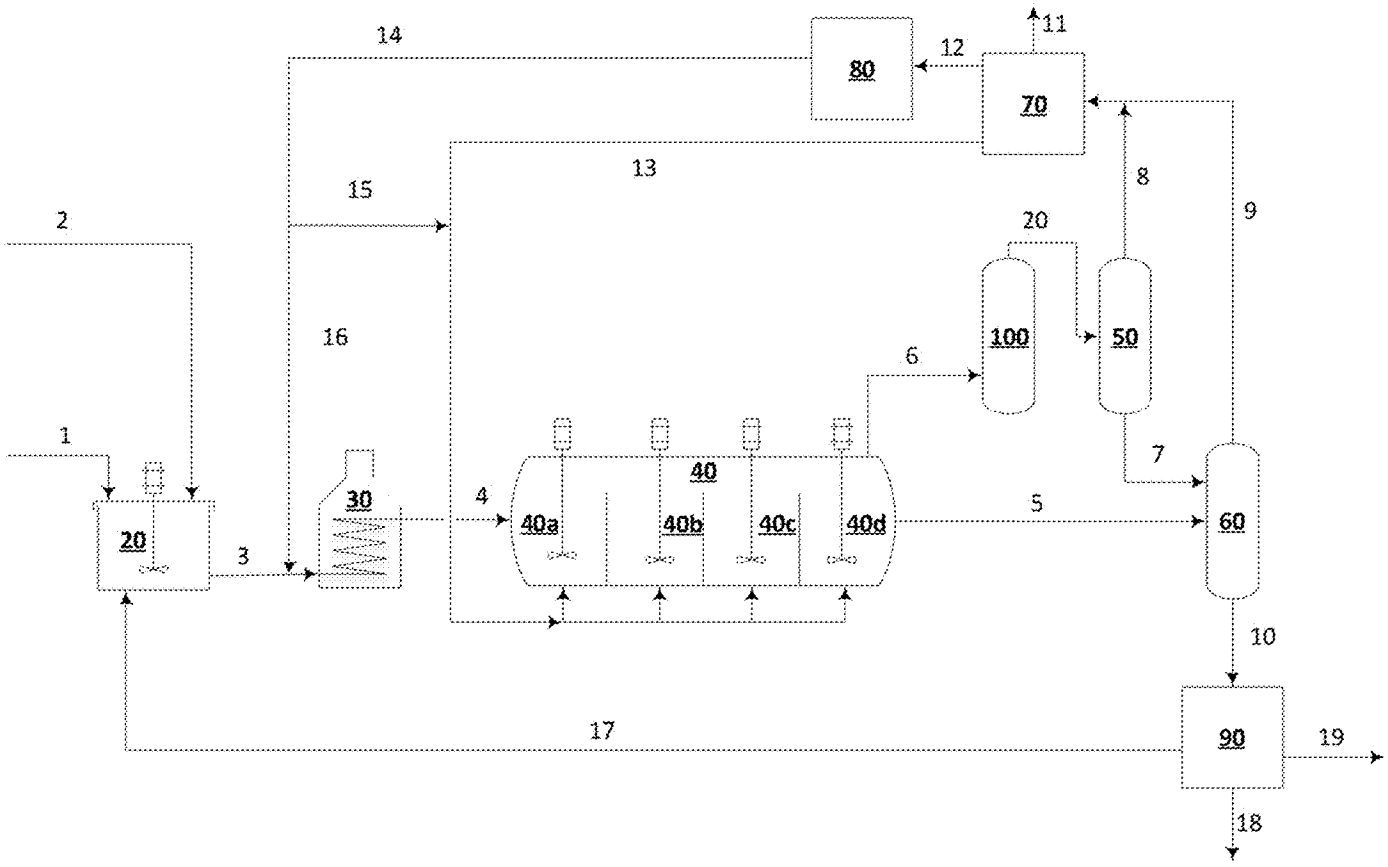
FIG. 3 is a flow diagram showing the partial upgrading process for heavy oil according to a second embodiment of the invention, and which includes an optional hydrotreatment step.

Exemplary embodiments for the process of the invention are shown in FIGS. 2 and 3. The process is effective in partially upgrading heavy oil, for example Canadian Oil Sands bitumen and other heavy/extra heavy oils, to meet the requirements for pipeline transportation; that is, having API gravity of at least 19° and a maximum viscosity of 350 cSt. In some embodiments, the process includes the following steps:

a) Preparing a feed slurry of a low activity solid particulate catalyst and a heavy oil feedstock which may be one or more of bitumen, heavy oil and extra-heavy oil in a tank equipped with a suitable mixer to form a pumpable slurry. In embodiments for extra-heavy oil and bitumen feed, the process includes heating the heavy oil feedstock to a free flowing temperature to reduce the initial viscosity of the feedstock prior to mixing with the catalyst.

b) Heating the feed slurry to a target reaction temperature for hydrocracking, for example by passing through one or more heating devices such as a heat exchanger and/or a natural gas, fuel gas, or electric heater.

c) Continuously feeding the heated slurry to a first reaction zone maintained at mild hydrocracking conditions, while introducing hydrogen to the first reaction zone. The first reaction zone is a first of multiple (two or more) stirred reaction zones, each of which is a compartment or reactor of a continuous stirred tank (CST) connected in series, with continuous stirring in each compartment or reactor. Stirring is preferably with one or more impellors on a rotating shaft or with other agitators, to achieve high shear three phase mixing of the slurry in each CST, with mixing being sufficient to keep the catalyst in suspension. The mild conditions are sufficient to achieve hydrocracking, producing a volatile vapour stream including condensable and non-condensable hydrocarbons and other product gases. Hydrogen is introduced, preferably in the vicinity of the stirrer(s), for example at or adjacent to the base of each compartment or reactor, and in excess and at a rate so that it acts as a sweeping or carrying gas to carry the volatile vapour stream upwardly from the reactor zone in each CST to produce an overhead vapour stream. The sweeping hydrogen conditions, preferably with a continuous introduction of hydrogen, and continuous removal of the overhead vapour stream from each reaction zone, reduces the residence time of the volatile vapour stream in the reaction zones relative to the residence time of the heavy oil slurry, and limits further hydrocracking of the condensable and non-condensable hydrocarbons in the volatile vapour stream within the heavy oil slurry within each reaction zone. The multiple reaction zones may be provided as a multi-compartment stirred tank (autoclave) with a shared atmosphere above each reaction zone, or a series of vertical CST reactors connected in series. The product removed from the last of the compartments or series of reactors is a partially upgraded heavy oil slurry product. The overhead vapour stream is removed from the multiple reaction zones. For a multi-compartment CST reactor with a shared atmosphere, the overhead vapour stream is removed from the shared atmosphere, such as above the last of the reaction zones.

Further processing of the partially upgraded heavy oil slurry and of the overhead vapour streams removed from the CST reaction zones, include one or more of the following steps, with the order of steps being variable, and with one or more of the steps being optional, depending on the particular specifications and applications for the process:

d) Cooling the partially upgraded heavy oil slurry, reducing the pressure of the partially upgraded heavy oil slurry, separating the solid catalyst from the partially upgraded heavy oil slurry in a solid liquid separation step to produce a partially upgraded oil stream, optionally recycling and re-using catalyst, and cleaning the partially upgraded oil stream, for example by steam stripping to remove residual $H_2S$.

e) Cooling the overhead vapour stream and subjecting the overhead vapour stream to a gas liquid separation step to produce a gas stream including hydrogen and non-condensable gases and a liquid hydrocarbon stream.

f) Combining the liquid hydrocarbon stream recovered from the overhead vapour stream with the partially upgraded heavy oil slurry (before or after cooling) to provide a partially upgraded heavy oil product, or combining the liquid hydrocarbon stream with the partially upgraded oil to produce a partially upgraded heavy oil product as a single, combined stream.

g) Optionally treating the overhead vapour stream to a hydrotreatment step, for example in a separate hydrotreatment reactor to saturate olefins contained in the condensable hydrocarbons and to produce a hydrotreated vapour stream, cooling the hydrotreated vapour stream, subjecting the hydrotreated vapour stream to a gas liquid separation step to produce a gas stream including hydrogen and non-condensable gases and a hydrotreated liquid hydrocarbon stream, and then either combining the hydrotreated liquid hydrocarbon stream with the partially upgraded heavy oil slurry (before or after cooling), such that after the solid liquid separation step a partially upgraded heavy oil product is produced, or combining the hydrotreated liquid hydrocarbon stream with the partially upgraded oil to produce a partially upgraded heavy oil product, as a single, combined stream.

Notable features of some embodiments of the upgrading process are set out below.

a) The use of a stirred multi-compartment autoclave or a plurality of vertical stirred autoclaves, with each compartment or vertical autoclave being a CST reactor, connected in series, provides a novel approach to partially upgrading heavy oil.

b) The multi-compartment or plurality of CST reactors configuration allows for the removal of non-condensable and condensable vapours from the reactor, to achieve a large difference in the residence time of light compounds (shorter residence time) and heavier compounds (longer residence time). To Applicant's knowledge, these features of the process have not been used in the upgrading of heavy oil.

c) The plurality of CST reactors are well suited to three-phase mass transfer for slurry hydrocracking. More specifically, the CST reactors are capable of suspending relatively dense slurries of the type that may form when significant amount of catalyst solids are used, for example pulp density of 5 to 20%, such as 10 to 15%. Thus, catalyst solids in the range of 2-20% (m/m), for example 5-15% (m/m), may be suspended in a relatively viscous medium in the process. This allows the use of a low activity catalyst that is present at a high concentration in the slurry.

d) The process is effective at mild hydrocracking conditions, for example a temperature in the range of 370 to 450° C., such as 400 to 450° C., which is within the target range of temperatures for slurry hydrocracking processes. The mild hydrocracking conditions may be adjusted to provide high conversion, high carbon recovery and low residues.

e) In some embodiments, the process is effective over a pressure range of 70 to 140 bar, such as 70 to 110 bars, with hydrogen being used as a carrier gas, with hydrogen consumption of 400 to 1300 scf/bbl feed, and with high shear three phase mechanical agitation/stirring within each reaction zone. It will be understood that pressure refers to the sum of partial pressures of all vapour components in the reactor, in other words the measured pressure.

f) Hydrogen flow rates provide hydrogen in excess of that consumed during hydrocracking in each reaction zone, such that excess hydrogen reports to the overhead vapour stream. This hydrogen flow rate ensures hydrogen acts as a sweeping or carrier gas to facilitate removal of the volatile vapour stream from the heavy oil slurry, reduces the residence time of the volatile vapour stream compared to the residence time of the heavy oil slurry in each reaction zone, and limits further hydrocracking of the volatile vapour stream within the heavy oil slurry.

g) While hydrogen flow rates provide hydrogen in excess of amounts needed for hydrocracking for partial upgrading, this excess of hydrogen is offset by limiting hydrocracking of the volatile vapours in the reaction zones, internal recovery of hydrogen, and hydrogen recycle such that the overall hydrogen requirement is reduced.

As above, the hydrocracking process is conducted in a plurality of reaction zones, each of which is a CST reactor connected in series, such as a multi-compartment stirred autoclave. This allows:

i. Intense 3-phase mixing resulting in improved mass transfer and uniform particle suspension;

ii. Smaller reactor due to reduced residence time (as a consequence of improved mass transfer);

iii. Differential residence time for the light hydrocarbons and heavy hydrocarbon fractions for control over the product slate, reduced non-condensable gas production, in-situ fractionation, and rapid removal of light hydrocarbon fractions as they form to reduce over cracking, and to extend the residence time of the heavier fractions;

iv. Simplification of the reactor internals, for example compared to an ebullated bed reactor; and v. Reactor operational flexibility (turndown, robustness), including residence time and throughput (gas make and carbon losses not affected), variable feed characteristics such as particle size of catalyst, viscosity of heavy oil, handling high pulp density (for high catalyst addition), and gas addition.

The hydrocracking process of this invention uses a low activity (and thus low cost), catalyst. Preferred catalysts are iron oxide based catalysts, or iron sulphide based catalysts, in contrast to the engineered, high activity catalysts of the prior art processes. In general, the catalyst may be one or more of goethite, hematite, magnetite, wustite, iron oxide containing waste streams, red mud, red slug. While the sulphide content of the heavy oil feedstock is typically sufficient to convert a catalyst precursor into a sulphided active form during (i.e., in situ) the hydrocracking process, the catalyst may be sulphided in advance of the hydrocracking process if the sulphide content of the feed is insufficient. Effective 3-phase mass transfer in the CST reactor enhances exposure of the macro-sized heterogeneous catalyst to the hydrocarbons without having to resort to a dispersed catalyst system of the prior art. The catalyst can be recovered, for example by settling, thus providing a simple catalyst recovery and recycling system.

Exemplary embodiments of the process are shown in the flow diagrams of FIGS. 2 and 3, with FIG. 3 showing an optional hydrotreating step not shown in FIG. 2.

FIG. 2 shows an embodiment of a process to produce partially upgraded heavy oil product (19) from heavy oil feedstock stream (1) using mild hydrocracking operating conditions and a low activity catalyst. The operating condition of this process can be manipulated so that the final product meets or exceeds the minimum pipeline transport requirements, generally a viscosity of less than 350 cSt and an API gravity of at least 19°. The heavy oil feed stream (1) is typically a "raw" heavy oil stream that has not been subjected to prior upgrading steps; however, the feedstock stream may be initially subjected to solvent removal steps (for example if it has been diluted with a solvent such as naphtha) and/or preliminary desalting steps, as is well known in the industry.

Heavy oil feed slurry stream (3), formed by mixing the heavy oil feedstock (1) with fresh solid particulate catalyst (2), and optionally recycled catalyst (17), in a well-mixed stirred tank (20) to form a pumpable slurry. For ease of handling, all or a portion of the heavy oil feed may be heated, for example to about 130° C. and mixed with the recycled catalyst stream in the stirred tank (20). The catalyst, such as an iron oxide or iron sulphide based catalyst, may be added, for example in the range of about 2 to 20% (m/m), for example 5 to 15% (m/m), of heavy oil feed. A catalyst particle size in the range of 1 to 200 microns, such as 1 to 100 microns, may be used. The catalyst and oil slurry (3) is pumped into a pre-heater furnace (30), for example one or more of slurry heat exchangers using indirect contact with the reactor vent gases and slurry products, and/or gas fired furnaces (30), to increase the temperature to the target reaction temperature for hydrocracking. For feedstocks having very low API gravity (for example 0° API, or even negative), this or a separate pre-heating step, ensures the feedstock may be pumped through the process lines. In some embodiments, if the feedstock is prone to pre-mature coking in the heater (30), a small stream of hydrogen (16), such as recycle hydrogen, may be added to the feedstock stream (3) to prevent coking in the heater (30).

The heated feed slurry stream (4) is pumped to a closed, multi-compartment reactor (40), maintained at mild hydrocracking conditions, for example temperatures ranging from 370 to 450° C. and pressures ranging from 70 to 140 bar, to produce a partially upgraded heavy oil slurry stream (5) and an overhead vapour stream (6). The multi-compartment reactor may have two or more compartments, such as four compartments (40*a*, 40*b*, 40*c* and 40*d*), each of which is stirred to provide a generally uniform distribution of the gas and solids in the heavy oil. A feature of the multi-compartment reactor (40) is a shared atmosphere above each of the compartments (40*a*-40*d*). The partially hydrocracked slurry from each compartment overflows the walls or is fed through one or more ports into the next, adjacent compartment, due to the continuous feed. The multi-compartment reactor may alternatively be substituted by a series of two or more CST reactors, with gravity feed of partially upgraded slurry streams from one reactor to the next. Each compartment (40*a*-40*d*) of the multi-compartment reactor (40), or each CST reactor, provides a reaction zone for the hydrocracking reactions to take place. Hydrogen (13) is supplied under pressure, for example by sparging at the base of each compartment (40*a*-40*d*), or each reactor in the case of a series of CST reactors, so that the excess hydrogen gas (i.e., excess to the hydrogen requirement of the hydrocracking reactions for partial upgrading) sweeps and carries gas products and light hydrocarbons upwardly out of the heavy oil slurry. The volatile vapour stream, which includes condensable and non-condensable hydrocarbons and other product gases, produces an overhead vapour stream in each compartment (40*a*-40*d*), which is continuously removed, for example from above the last compartment of reactor (40*d*), or from each of the CST reactors. This continual removal of the overhead vapour stream removes the vapours as soon as they start to crack to a molecule size that allows them to become volatile under the prevailing conditions in the reactor, for example to the extent that their API gravity becomes larger than 25° API. This prevents undesired further cracking of light hydrocarbon molecules and reduces hydrogen consumption. Hydrogen is thus primarily used to crack heavy hydrocarbons such as asphaltenes into lighter molecules. The process also reduces gas production and carbon loss. Excess gas production is the result of cracking chain reactions that occur if the residence time in the reactor and under the reaction conditions is too high for light molecules. By providing stirring, hydrogen sparging and continuous removal of light phases, molecules that can enter the vapour phase have limited time to crack to smaller molecules and hence the gas make is reduced.

In some embodiments, hydrogen consumption is managed so that the amount of hydrogen consumed by light hydrocarbon molecules (for example API>25°) is reduced and heavy molecules such as asphaltenes, resins and other residues absorb most of the hydrogen. This reduces the overall hydrogen consumption for the process which in turn reduces the operating costs.

The reactor system of some embodiments provides reduced reactor size, compared to some of the prior art processes, due to the managed residence time for various species. For an average residence time of one hour based on the feed slurry supplied to the reactor, the residence time of light species (API>25°) can be as low as 15 minutes, that is the light hydrocarbons leave the reactor once they reach the first compartment (40*a*). For heavy components, the total residence time in the reactor (40) depends on feedstock (1) properties such as API gravity and boiling point distribution and may be as high as 90 minutes.

In some embodiments, the reactor arrangement of the process provides a narrow product distribution. Since the components leave the reactor as soon as they become a certain size, the production of very light product of inferior quality such as light naphtha and gases is reduced and more gasoil cut is produced.

In some embodiments, the process has a high volumetric yield. Because the operating conditions are mild and gas production is reduced, the volumetric yield or yield of the product is normally greater than 100% (v/v) and can be as high as 110% (v/v), that is, the volume of partially upgraded product is 10% more than the initial volume of the feedstock.

Volatile vapour stream (6) from the overhead of the upgrading reactor is cooled and condensed and the condensable portion is separated from the non-condensable gases in the gas-liquid separator (50). Gas liquid separator (50) may be a combination of heat exchangers and knockout vessels where light liquids are separated from the vapour phase in one, two or three steps. The gas stream is mainly hydrogen (over 80% (v/v) is preferred in some embodiments). Other non-condensable gases such as methane, ethane, propane, butanes, hydrogen sulphide, and carbon dioxide make up the non-hydrogen part of the gas stream. For example, in experimental testing, a non-condensable gas stream (8) containing 90% (v/v) of hydrogen was obtained, and out of the remaining 10% (v/v), 43% (v/v) methane, 19% (v/v) ethane, 18% (v/v) hydrogen sulphide, 9% (v/v) propane, 4% (v/v) butane, 1% (v/v) carbon dioxide and 6% (v/v) other gases were detected.

The liquid stream (7) including liquid hydrocarbons of API gravity >25° may be used as a separate light product if desired, or may be added to the final product pool and mixed with the partially upgraded heavy oil product to produce a single partially upgraded heavy oil stream. It may also be beneficial to combine liquid stream (7) with the partially upgraded heavy oil slurry stream (5) in tank (60) to benefit from lower viscosity of the combination, which makes the solid liquid separation easier.

The partially upgraded heavy oil slurry stream (5) leaving the reactor (40) is cooled, for example with feed slurry in a feed-effluent heat exchanger, and/or with water-cooled heat exchangers. The pressure of the high pressure partially upgraded heavy oil slurry (5) is reduced, for example using a flash tank (60), where the partially upgraded heavy oil slurry (5) may be mixed with liquid hydrocarbon stream (7). Alternatively, the liquid hydrocarbon stream (7) might be combined after catalyst separation.

Combined partially upgraded heavy oil slurry stream (10) from tank (60), or simply the partially upgraded heavy oil slurry stream (5), is then sent to solids rejection unit (90) to separate solid catalyst from the slurry product stream, for example in a series of hydrocyclones, decanters, centrifuges or filtering units. The majority of the catalyst in the system is recycled as a concentrated slurry (17) while a small stream of used catalyst (18) is rejected from the process for disposal. Depending on the type of feed and operating conditions, 5 to 20% (m/m) of the catalyst in stream (10) may be rejected, and a similar amount of fresh catalyst may be added in stream (2)

The partially upgraded heavy oil product stream (19) may be further treated, for example by gas stripping to remove residual $H_2S$ and dissolved gases.

The catalyst materials may be sourced from iron oxide based compounds such as goethite and hematite, iron oxide containing waste products such as red mud or red slug, or iron sulphide based compounds such a pyrite or pyrrhotite, for use as an inexpensive, low activity catalyst for this process. The iron oxide may be converted into an iron sulphide that may include the form $Fe_{(1-x)}S$ (x=0 to 0.2) in the presence of sulphur contained in the feed, with iron sulphide acting as the hydrocracking catalyst for heavy hydrocarbons. Sulphur may be added to the process for low sulphur feedstock, but in the case of Athabasca bitumen and the majority of heavy/extra heavy oils in the world, there is enough sulphur in the chemical structure of the feedstock to activate the catalyst. Thus, for most heavy oil feedstocks, the catalyst activation is achieved in-situ during the hydrocracking reaction although it can be done prior to the reaction in a sulphiding environment.

The solids rejection unit (90) may comprise gravity type separators such as gravity settlers and centrifuges. Gravity settlers, hydrocyclones or decanter centrifuges may be used for the initial separation of the recycle catalyst slurry. The product stream may then be sent to high speed centrifuge or filter units to remove traces of fine catalyst. All gas streams (8, 9) are collected and routed to the hydrogen purification and hydrogen sulphide separation unit (70). Hydrogen sulphide separation may be any commercially available sour gas treatment processes such as traditional amine treating or more advanced Selexol processes. The produced $H_2S$ stream (11) is usually treated in a Claus plant to produce elemental sulphur. Hydrogen may be separated from the gas stream by pressure swing adsorption or other methods. The hydrogen separated in this way is recycled back to the reactor where it is sparged into the reaction slurry through spargers mounted at the bottom of each reactor compartment.

Non-condensable gases (12) produced in unit (70) contain light hydrocarbon gases mainly methane, ethane, propane, and butane and hence contain hydrogen. This stream (12) is sent to a hydrogen production unit (80) to produce hydrogen (14) for the process. The hydrogen production unit may be a commercially available steam reforming plant. This provides hydrogen that is sufficient for the operation of the plant, with little or no additional fuel being required for hydrogen production. In some embodiments, the hydrogen (15) produced in this manner is sent to the reactor to supply hydrogen requirements for hydrocracking reactions. As above, hydrogen (16) may optionally be fed to the heater (30) to limit coking.

FIG. 3 shows an embodiment of the process to produce a partially upgraded heavy oil product, and in which a hydrotreating step is added. The features of FIG. 2 which are common to the process of FIG. 3 are labelled with the same reference numerals. The overhead vapour stream (6) from the multi-compartment hydrocracking reactor (40) is fed to a hydrotreatment reactor (100) where hydrogen is added to double bonds to hydrotreat olefins to produce a hydrotreated vapour stream. The hydrotreated vapour stream (20) is removed from the reactor (100) and is cooled and condensed. The condensable portion of stream (20) is separated from non-condensable gases in a gas liquid separator (50).

Based on experimental testing, modeling and experience with commercial multi-compartment stirred autoclaves, the following may be achieved in some embodiments of the process:

1. High carbon efficiency, with a high conversion of oil to product of 85 to 95% (m/m), 95 to 110% (v/v).
2. Effective use of gas-make for hydrogen and process heat.
3. Improved selectivity, including selectivity to heavier hydrocarbons over lighter hydrocarbons, with asphaltenes effectively eliminated by hydrocracking, using low activity catalyst and low hydrogen consumption.
4. Flexibility, to tolerate changes to the density of hydrocarbon-catalyst slurry and to accommodate different hydrogen addition rates.
5. Less complex reactor than ebullated bed or bubble column reactors.
6. Hydrogen can be generated in a small hydrogen plant for a process which is low in hydrogen consumption.
7. Unlike the complex, expensive supported catalysts of the prior art processes, a low activity, low cost catalyst may be used, with a simple catalyst recovery system.
8. Mild conditions, with temperature in the range of 370 to 450° C., such as 400 to 450° C., pressure in the range of 70 to 140 bar, such as 90 to 120 bar, and residence time for the liquid product in the range of 15 to 90 minutes, for example 30 to 60 minutes.

Other notable features or advantages of some embodiments are set out below.

1. The process provides sufficient upgrading of a heavy oil to meet current pipeline specifications of a maximum viscosity of 350 cSt and a minimum API gravity of 19°.
2. The partial upgrading process reduces asphaltenes, sulphur, heavy metals and heteroatoms such as oxygen and nitrogen from the oil which in turn improves the quality and adds value to the heavy oil stream.
3. Olefins and cyclic olefins produced in the process can be hydrotreated in an efficient manner, since the olefins report in high amounts to the overhead vapour stream, allowing for a hydrotreatment step to be conducted on only a small portion of product streams from the process.
4. With respect to improving carbon efficiency, a maximum amount of carbon in the feed oil may be recovered in the product, subject to economic constraints. This recovery may be achieved by:

i. Ensuring that there is sufficient addition of hydrogen to avoid the formation of pitch and coke;

ii. Ensuring that the conversion of lighter ends to non-condensable hydrocarbon gases is reduced;

iii. Achieving a desirable range of hydrocarbon weights such that the yield of liquids products is increased; and iv. Reducing the emission of secondary gases such as carbon dioxide, nitrous oxide, sulphurous oxides and sour gases.

5. Capital and operating cost intensity for partial upgrading may be reduced. These costs are dominated by several factors, including:

i. The requirement for hydrogen. By reducing the amount of hydrogen required to produce a suitable product in high yield, the capital and feed stock requirements of a hydrogen plant are reduced.

ii. Achieving optimal physical and chemical properties in the product by operating under mild conditions, most especially temperature and pressure. These conditions impact on the type and amount of material used in the construction of the upgrading plant as well as the energy footprint of that plant. Achieving high yield in a reasonable time period reduces the size of the plant.

iii. Elimination or simplification of unit operations wherever possible, including the requirements for feed and product fractionation as well as catalyst handling and recovery.

EXAMPLES

The following examples provide experimental evidence for the present invention and are presented to illustrate and demonstrate specific features or conditions for the practice of this invention and should not be interpreted as a limitation upon the scope of that invention. Operating parameters, for example temperature, pressure, residence time and catalyst loading, were tested under both batch and semi-continuous gas phase conditions in a bench-top autoclave and also in a continuous pilot plant, on samples of bitumen and sour heavy oil.

Example 1

This example shows the effectiveness of the process in the partial upgrading of a sample of Athabascan bitumen. A slurry of 15% (m/m) of fresh goethite ($D_{50}$<30 μm) and a sample of Athabasca bitumen with 54% (m/m) residue was heated to 450° C. under a fixed hydrogen pressure of 110 bar in a 0.5 liter stirred autoclave. Hydrogen flow was maintained at 1.1 to 1.2 liters per minute. A reflux condenser on top of the reactor returned the condensable hydrocarbons in the vent gas stream back to the reactor, while the non-condensable gases were continuously removed. The residence time of the slurry at the target temperature of 450° C. was 60 minutes. The products were then cooled to room temperature before the reaction vessel was opened. Catalyst particles were separated from the product slurry using vacuum filtration. A sample of the liquid product was characterized by viscosity and density measurements as well as by determination of boiling point distribution using simulated distillation. The collected solid was washed thoroughly with tetrahydrofuran (THF) in order to remove any remaining oil. The mass difference between the collected solids and initial catalyst was then reported as coke.

The density of the liquid product was found to decrease from about 1010 g/L to about 874 g/L, as shown in Table 1 (Example 1). The viscosity of the product was about 5 cSt compared to the viscosity of the feed which was greater than 100 000 cSt at 25° C. There was no detectable coke formation and the gas yield was 12% (m/m) of the feed oil. Owing to the decrease in the density of the reaction products, the volumetric yield was 101%. More than about 91% (m/m) of the residue fraction in the feed was converted to lighter fractions such as naphtha, diesel and vacuum gas oil. About 51% of the sulphur in the feed was removed in the form of $H_2S$ and iron sulphide.

Example 2

In order to show the impact of pressure, the test described in Example 1 was repeated with all other conditions unchanged except that the pressure was reduced to 70 bar, as shown in Table 1 (Example 2). Under these conditions about 4% (m/m) coke was formed on the catalyst. The density of the liquid product decreased from about 1010 g/L to about 903 g/L while the measured viscosity was about 7 cSt. The gas yield was about 18% (m/m) of the feed oil, which is higher than that from the test conducted at 110 bar (Example 1). This increase is attributed to gas evolution associated with coking reactions. The conversion of the residue to lighter fractions was about 88% (m/m). More than about 45% of the sulphur in the feed was removed in the form of $H_2S$ and iron sulphide.

Example 3

In order to show the impact of temperature, the test described in Example 1 was repeated with all other conditions unchanged, except that the temperature was reduced to 430° C. The results are shown in Table 1 (Example 3). The gas yield was about 7% (m/m) which is lower than for the test conducted at 450° C. The density of liquid product was about 916 g/L compared to about 874 g/L for the liquid produced at 450° C. The conversion of residue to lighter fraction was about 72% (m/m) which is lower than for the test at 450° C., where the conversion was about 91% (m/m). More than about 36% of sulphur in the feed was removed in the form of $H_2S$ and iron sulphide.

Example 4

The impact of temperature was further demonstrated by repeating the tests of Examples 1 and 3, but at 410° C. The results are shown in Table 1 (Example 4). The gas yield was about 7% (m/m), which was lower than for the test conducted at 450° C. but similar to that at 430° C. The density of liquid product was about 950 g/L compared to about 874 g/L for the liquid produced at 450° C. and about 916 g/L at 430° C. The viscosity of the liquid product was about 543 cSt compared to 5-7 cSt for the products produced at 430° C. and 450° C. Conversion of the residue to lighter fractions was 71% (m/m). About 21% of the sulphur in the feed was removed in the form of $H_2S$ and iron sulphide.

Example 5

The effect of reduced temperature and pressure was demonstrated by repeating the test as described in Example 3, but at a lower pressure of 90 bar. The results are shown in Table 1 (Example 5). The outcome was unexpected, showing that, at 430° C., a pressure of 90 bar produced results that were comparable to 110 bar, and hence operation at lower pressure may provide acceptable results for partial upgrading. This is an indication of the robustness of the process of the invention to the changes in operating pressure.

Example 6

The effect of residence time was demonstrated by repeating Example 5 but at a lower residence time of 20 minutes. The test resulted in higher viscosity and density for the product as well as lower yield, when compared to the results of Example 5. However, the test demonstrates that lower than 60 minutes residence times may be sufficient for partial upgrading, for example with lighter heavy oils.

Example 7

The impact of catalyst loading was demonstrated by conducting the test in Example 5, but with a lower catalyst loading of 8% (m/m). It can be seen from Table 1 that the density and viscosity results were very similar to those of Example 5, while higher volumetric yield of 103% associated with lower gas make was observed. Unexpectedly, the conversion in this case was considerably higher than that of Example 5. Thus, successful operation at a lower catalyst loading is not only possible but also beneficial.

TABLE 1

Conditions and Results for Examples 1-7

| | Ex. 1 | Ex. 2 | Ex. 3 | Ex. 4 | Ex. 5 | Ex. 6 | Ex. 7 |
|---|---|---|---|---|---|---|---|
| Conditions | | | | | | | |
| Temperature, ° C. | 450 | 450 | 430 | 410 | 430 | 430 | 430 |
| $H_2$ pressure, bar | 110 | 70 | 110 | 110 | 90 | 90 | 90 |
| Residence time*, minutes | 60 | 60 | 60 | 60 | 60 | 20 | 60 |
| Catalyst loading, % ($^m/_m$) feed oil | 15 | 15 | 15 | 15 | 15 | 15 | 8 |
| Partially Upgraded Product | | | | | | | |
| Density @ 25° C., g/L | 874 | 903 | 916 | 950 | 926 | 950 | 928 |
| Density@ 15° C., g/L | 882 | 911 | 924 | 958 | 934 | 958 | 936 |
| API gravity @ 15° C., ° | 29 | 24 | 22 | 16 | 20 | 16 | 20 |
| Viscosity @ 25° C., cSt | 5 | 7 | 51 | 543 | 53 | 167 | 45 |
| Coke yield, % ($^m/_m$) of feed oil | 0 | 4 | 0 | 0 | 0 | 0 | 0 |
| Gas make, % ($^m/_m$) of feed oil | 12 | 18 | 7 | 7 | 8 | 9 | 6 |
| Conversion, % ($^m/_m$) | 91 | 88 | 72 | 71 | 76 | 85 | 91 |
| Desulphurization, % of S in feed oil | 51 | 45 | 36 | 21 | 33 | 21 | 35 |
| Yield, % ($^v/_v$) of feed oil | 101 | 92 | 102 | 98 | 101 | 97 | 103 |

*There was a period of 30 minutes to heat up from room temperature to the target temperature Example 8

This example demonstrates that olefins are disproportionately concentrated into light molecules which report to volatile vapour phase during the partial upgrading process, allowing for more effective hydrotreating of the olefins. A test was carried out in a 1.8 liter reactor with a condensate cooling and collection system. Excess hydrogen, non-condensable gases, and volatile hydrocarbon vapours are cooled in an overhead condenser; but unlike previous examples, the condensed liquids were collected in the condenser instead of being refluxed back into the reactor. A slurry of 15% (m/m) fresh goethite and a heavy oil with properties shown in Table 2, was heated to 430° C. and a pressure of 120 bar under hydrogen at a flow rate of 1.0 liter per minute in the reaction system described above. The residence time at 430° C. was 60 minutes. Light condensate from the condenser collection vessel and liquids from the reactor were collected separately. The reactor contents were filtered to separate catalyst particles from the liquid; the oily catalyst was washed with THF and dried. The results are shown in Table 3 (Example 8). Of the total product collected, approximately 1% (m/m) was condensate and the balance was reactor liquids. The condensate had an olefin content of 26.42% (m/m) and the reactor liquids had an olefin content of 2.05 wt %. The high olefin content of the condensate indicates that the olefins are concentrated in the light condensate.

Example 9

This example demonstrates that excess hydrogen may be used to mobilize volatile hydrocarbons which results in an effective segregation of volatile and non-volatile phases. A test similar to Example 8 was conducted but with a higher hydrogen flow rate of 5.6 liters per minute. The light condensate from the condenser collection vessel and the liquids from the reactor were collected separately. The reactor contents were filtered to separate catalyst particles from the liquid. The oily catalyst was washed with THF and dried. The results are shown in Table 3 (Example 9). It was observed that the increased hydrogen flowrate results in a reduction of olefin content in the reactor liquid. Of the total product collected, approximately 16% (m/m) was collected as condensate and 84% (m/m) as reactor liquids. The condensate had an olefins content of 11.37% (m/m) and the reactor content had an olefin content of 1.56 wt %.

TABLE 2

Initial Properties of Heavy Oil

| | |
|---|---|
| API gravity @ 15° C. | 11.6 |
| Viscosity @ 15° C., cSt | 41 000 |
| Total acid number, mgKOH/g | 0.97 |
| Total sulphur content, % ($^m/_m$) | 6.1 |
| $C_7$-Asphaltene content, % ($^m/_m$) | 11.7 |

TABLE 3

Conditions and Results (Examples 8 and 9)

| | Example | Example |
|---|---|---|
| Temperature, ° C. | 430 | 430 |
| Hydrogen pressure, bar | 120 | 120 |
| Residence time, minutes | 60 | 60 |
| Catalyst loading, wt % feed oil | 15 | 15 |
| Hydrogen flow, l/min | 1.0 | 5.6 |
| Density @ 15° C., g/L | 926 | 923 |
| API gravity @ 15° C. | 21 | 22 |
| Viscosity @ 15° C., cSt | 26 | 29 |
| Coke yield, % ($^m/_m$) of feed oil | 0 | 0 |
| Gas make, % ($^m/_m$) of feed oil | 6 | 5 |
| Conversion, % ($^m/_m$) | 73 | 71 |
| Desulphurization, % of S in feed oil | 37 | 37 |
| Yield, % ($^v/_v$) of feed oil | 101 | 101 |
| Condensate collected, % ($^m/_m$) of product | 1 | 16 |
| Olefin content of reactor liquids, wt % | 2.05 | 1.56 |

Example 10

The following example demonstrates the implementation of the process of the invention in a continuous pilot plant comprised of four continuously fed stirred reactors connected in series and operating under steady-state conditions. The slurry flowed from one continuously fed stirred reactor to another by means of gravity and the gas spaces in each vessel were connected. Hydrogen was sparged into the slurry phase of first and second continuously fed stirred reactor in the vicinity of the impellers and excess hydrogen along with produced gas and condensable vapours were removed from the fourth continuously fed stirred reactor. The majority of non-condensable vapours were refluxed back to the fourth autoclave after being cooled and condensed in an overhead condenser. Partially upgraded heavy oil slurry was collected in a pressure let down tank and cooled. The temperature of each continuously fed stirred reactor was controlled independently with the first continuously fed stirred reactor normally used as slurry preheater at 350° C. A slurry of 15% (m/m) fresh goethite and a heavy oil was fed to the pilot plant described above at a rate of 5.4 kg/hr. Sufficient time was allowed to ensure steady state with respect to catalyst concentration and operating condition was reached. The residence time of the slurry at the target temperature of 440° C. was 90 minutes. The results are shown in Table 4.

TABLE 4

Conditions and Results (Example 10)

| | Example |
|---|---|
| Operating temperature, ° C. | 440 |
| Operating pressure, bar | 115 |
| Residence time, minutes | 90 |
| Catalyst loading, wt % feed oil | 15 |
| Feed slurry flow rate, kg/hr | 5.4 |
| Total hydrogen flow, kg/hr | 0.6 |
| API gravity @ 15° C. | 27 |
| Viscosity @ 15° C., cSt | 10 |
| Total acid number, mgKOH/g | 0.1 |
| $C_7$-Asphaltene content, % ($^m/_m$) | 0.93 |
| Coke yield, % ($^m/_m$) of feed oil | 0 |
| Gas make, % ($^m/_m$) of feed oil | 6 |
| Conversion, % ($^m/_m$) | 70 |
| Desulphurization, % of S in feed oil | 62 |
| Yield, % ($^v/_v$) of feed oil | 104 |
| Product olefin content, % ($^m/_m$) | 2.99 |
| 340° C.$^+$ olefin content, % ($^m/_m$) | 0.57 |

Based on experiments, a number of observations are set out below.

1. Heavy oil was upgraded to increase the API from 8° to between 19 and 35° and to lower the viscosity from greater than 40 000 cSt to less than 100 cSt (at 15° C.) in most of the examples.

2. The sulphur content of the heavy oil was reduced from greater than 6% (m/m) to between about 2 and 4% (m/m).

3. Hydrocracking of heavy oil in the presence of goethite shifted the product distribution toward naphtha and middle distillates. Asphaltenes and residue were hydrocracked to less heavier oil, resulting in reduced residue to the product oil and a high yield of naphtha and diesel products.

4. The chemical and physical properties of the products change significantly over the temperature range of 410 to 450° C. Below 410° C., the rate of thermal hydrocracking is slow and the product yield is low. Above 450° C., extensive coke formation occurs, resulting in low yields of liquid products.

5. A change in residence time from 20 to 60 minutes also affects the chemical and physical properties of the products. Most of the gas is produced within the first 20 minutes but desulphurization and density and viscosity reduction continue with the increasing residence time.

6. A catalyst loading of about 10% (m/m) at 450° C. prevents coke formation. Below 450° C., a lower catalyst loading, of 2 to 10% (m/m), such as 5 to 10% (m/m), is possible.

7. Approximately 5% to 15% (m/m) of the feed is lost as non-condensable gas.

8. A liquid product yield of 85% to 95% (m/m) and 95% to 105% (v/v) may be obtained.

9. An increase in hydrogen flow results in reduced gas make which indicates that a rapid removal of light condensate prevents further cracking of light hydrocarbons to non-condensable gases.

While the specific operating conditions are not selected based solely on the physical and chemical properties of the products (capital and operating cost evaluations are also assessed for each operating condition along with the value of the upgraded products) a window of exemplary operating conditions based on experimental work can be specified. In some embodiments, and for maximum upgrading of very heavy feeds, the density, viscosity, yield and extent of desulphurization can be manipulated by controlling temperature over the range of 430 to 450° C., pressure between 90 and 110 bar, catalyst loading of 10 to 15% (m/m) and total residence time for the hydrocracking between 30 and 90 minutes. For less heavy oils, and in a steady state environment of a multi-compartment stirred autoclave, more mild conditions may be used, as summarized in Table 5.

TABLE 5

Exemplary Operating Ranges/Design Features for Heavy Oil Upgrading Process

| | Units | Lower Range | Upper Range |
|---|---|---|---|
| Operating pressure | bar | 70 | 140 |
| Operating temperature | ° C. | 370 | 450 |
| Residence time | minutes | 15 | 90 |
| Catalyst loading | % ($^m/_m$) of feed oil | 5 | 20 |
| Hydrogen consumption | scf/bbl of feed oil | 400 | 1300 |
| Mass yield | % ($^m/_m$) of feed oil | 85 | 95 |
| Yield | % ($^v/_v$) of feed oil | 95 | 105 |

The experimental conditions set out above for the processes of the invention are exemplary only and the invention may be practised under other conditions without departing from the invention.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All publications mentioned in this specification are indicative of the level of skill of those skilled in the art to which this invention pertains. All publications are herein incorporated by reference to the same extent as if each individual publication was specifically and individually indicated to be incorporated by reference.

The terms and expressions used in this specification are used as terms of description and not of limitation. There is no intention, in using such terms and expression of excluding equivalents of the features shown and described, it being recognized that the scope of the invention is defined and limited only by the claims which follow.

We claim:

1. A process for partial upgrading of a heavy oil feedstock, comprising:

mixing the heavy oil feedstock and a solid particulate catalyst, with optional heating to reduce the initial viscosity of the feedstock, to form a pumpable slurry;

heating the slurry to a target temperature for hydrocracking;

continuously feeding the heated slurry to a first reaction zone comprising a first continuous stirred tank maintained at hydrocracking conditions while continuously introducing hydrogen to the first reaction zone to achieve hydrocracking of the heavy oil in the slurry and to produce a volatile vapour stream including condensable and non-condensable hydrocarbons and other gases, and carrying the volatile vapour stream upwardly with the hydrogen in the first reaction zone to produce an overhead vapour stream;

continuously feeding the hydrocracked heavy oil slurry from the first reaction zone to a second reaction zone comprising a second continuous stirred tank maintained at same or different hydrocracking conditions as in the first reaction zone, while continuously introducing hydrogen to the second reaction zone to achieve further hydrocracking of the heavy oil in the slurry and to produce a volatile vapour stream including condensable and non-condensable hydrocarbons and other gases, and carrying the volatile vapour stream upwardly with the hydrogen in the second reaction zone to produce an overhead vapour stream;

optionally continuously feeding the further hydrocracked heavy oil slurry from the second reaction zone to one or more further reaction zones connected in series, each further reaction zone comprising a further continuous stirred tank maintained at same or different hydrocracking conditions as in the first and second reaction zones, while continuously introducing hydrogen to each of the one or more further reaction zones to achieve further hydrocracking of the heavy oil in the slurry and to produce in each further reaction zone a further volatile vapour stream including condensable and non-condensable hydrocarbons and other gases, and carrying the volatile vapour stream upwardly with the hydrogen in each of the one or more further reaction zones to produce a further overhead vapour stream for each of the one or more further reaction zones;

continuously removing the overhead vapour stream from the first, second and any of the one or more further reaction zones; and removing the further hydrocracked heavy oil slurry from the second reaction zone or from the last of the one or more further reaction zones to provide a partially upgraded heavy oil slurry.

2. The process of claim 1, wherein stirring in each of the first, second and any of the one or more further continuous stirred tanks is three phase mixing, and is sufficient to maintain the catalyst in suspension.

3. The process of claim 2, wherein:

each of the first, second and any of the one or more further continuous stirred tanks is stirred with one or more impellers on a rotating shaft; and hydrogen is introduced in the vicinity of the one or more impellers in each of the first, second and any of the one or more further continuous stirred tanks.

4. The process of claim 3, wherein the hydrocracking conditions are mild hydrocracking conditions including a temperature in the range of 370 to 450° C. and a pressure in the range of 70 to 140 bar.

5. The process of claim 4 wherein the temperature is in the range of 400 to 450° C., and wherein hydrogen is introduced at the base of each of the first, second and any of the one or more further continuous stirred tanks.

6. The process of claim 4, wherein the mild hydrocracking conditions include a pressure in the range of 90 to 120 bar.

7. The process of claim 4, wherein the mild hydrocracking conditions include a temperature in the range of 430 to 450° C.

8. The process of claim 1, wherein hydrogen is continuously introduced at a rate into each of the first, second and any of the one or more further reaction zones and wherein the overhead vapour stream is removed from each of the first, second and any of the one or more further reaction zones at a rate, such that the rates of introducing hydrogen and the rates of removing the overhead vapour stream are sufficient to reduce the residence time of the condensable and non-condensable hydrocarbons in each of the first, second and any of the one or more further reaction zones compared to the residence time of the heavy oil slurry in each of the first, second and any of the one or more further reaction zones, and to limit further hydrocracking of the condensable and non-condensable hydrocarbons in the heavy oil slurry.

9. The process of claim 8, wherein the rates of introducing hydrogen are sufficient that excess hydrogen reports to the overhead vapour stream.

10. The process of claim 1, further comprising one or more of:

the catalyst is an iron oxide based catalyst or an iron sulphide based catalyst;

the catalyst is a solid particulate catalyst with a particle size in the range of 1 to 200 microns; and the catalyst is included in the slurry in an amount in the range of 2 to 20% ($m/_m$).

11. The process of claim 10, wherein the catalyst is selected from the group consisting of goethite, hematite, magnetite, wustite, iron oxide containing waste streams, red mud, mixtures of same, and sulphided forms of same, wherein sulphiding is performed before or during hydrocracking.

12. The process of claim 11, wherein the catalyst has a particulate size between 1 and 100 microns, and is included in the slurry in an amount in the range of 5 to 15% ($m/_m$).

13. The process of claim 1, wherein each of the first, second and one or more further reaction zones are compartments in a multi-compartment continuous stirred tank having a shared atmosphere, and wherein the overhead vapour stream is removed from the shared atmosphere.

14. The process of claim 13, wherein the overhead vapour stream is removed from the shared atmosphere above the last of the reaction zones.

15. The process of claim 14, further comprising:

cooling the overhead vapour stream;

subjecting the overhead vapour stream to a gas liquid separation step to produce a gas stream including hydrogen and non-condensable gases and a liquid hydrocarbon stream.

16. The process of claim 15, further comprising:

cooling the partially upgraded heavy oil slurry;

reducing the pressure of the partially upgraded heavy oil slurry; and subjecting the partially upgraded oil slurry to a solid liquid separation step to remove the catalyst, and to produce a partially upgraded oil.

17. The process of claim 16, further comprising, either:

combining the liquid hydrocarbon stream with the partially upgraded heavy oil slurry before or after cooling, such that, after the solid liquid separation step, a partially upgraded heavy oil product is produced; or combining the liquid hydrocarbon stream with the partially upgraded oil to produce a partially upgraded heavy oil product.

18. The process of claim 16, further comprising recycling at least a portion of the removed catalyst to the mixing step.

19. The process of claim 14, further comprising:

treating the overhead vapour stream to a hydrotreatment step to hydrotreat olefins and to produce a hydrotreated vapour stream;

cooling the hydrotreated vapour stream; and subjecting the hydrotreated vapour stream to a gas liquid separation step to produce a gas stream including hydrogen and non-condensable gases and a hydrotreated liquid hydrocarbon stream.

20. The process of claim 19, further comprising:

cooling the partially upgraded heavy oil slurry;

reducing the pressure of the partially upgraded heavy oil slurry; and subjecting the partially upgraded heavy oil slurry to a solid liquid separation step to remove the catalyst, and to produce a partially upgraded oil.

21. The process of claim 20, further comprising, either:

combining the hydrotreated liquid hydrocarbon stream with the partially upgraded heavy oil slurry before or after cooling, such that after the solid liquid separation step, a partially upgraded heavy oil product is produced; or combining the hydrotreated liquid hydrocarbon stream with the partially upgraded oil to produce a partially upgraded heavy oil product.

22. The process of claim 20, further comprising recycling at least a portion of the removed catalyst to the mixing step.

23. The process of claim 15, further comprising treating the gas stream to one or more of a hydrogen purification step, a hydrogen sulphide separation step, and a hydrogen production step to produce a hydrogen-containing gas stream.

24. The process of claim 23, which further comprises recycling the hydrogen-containing gas to one or more of the first, second, and any of the one or more further reaction zones.

25. The process of claim 23, which further comprises recycling the hydrogen-containing gas to the heating step to reduce coke formation during heating to the target temperature for the hydrocracking.

* * * * *